US011241777B2

(12) United States Patent
Fan et al.

(10) Patent No.: US 11,241,777 B2
(45) Date of Patent: Feb. 8, 2022

(54) POWERED FASTENER DRIVING TOOLS AND CLEAN LUBRICANTS THEREFOR

(71) Applicant: Illinois Tool Works Inc., Glenview, IL (US)

(72) Inventors: Chinbay Q. Fan, Chicago, IL (US); Patrick Talano, Chicago, IL (US)

(73) Assignee: Illinois Tool Works Inc., Glenview, IL (US)

( * ) Notice: Subject to any disclaimer, the term of this patent is extended or adjusted under 35 U.S.C. 154(b) by 163 days.

(21) Appl. No.: 16/202,511

(22) Filed: Nov. 28, 2018

(65) Prior Publication Data

US 2019/0168368 A1 Jun. 6, 2019

Related U.S. Application Data

(60) Provisional application No. 62/594,877, filed on Dec. 5, 2017.

(51) Int. Cl.

| | |
|---|---|
| ***B25C 1/00*** | (2006.01) |
| ***B25C 7/00*** | (2006.01) |
| ***B25C 1/04*** | (2006.01) |
| ***B25C 1/08*** | (2006.01) |

(52) U.S. Cl.

CPC ..... *B25C 7/00* (2013.01); *B25C 1/008* (2013.01); *B25C 1/047* (2013.01); *B25C 1/08* (2013.01)

(58) Field of Classification Search

CPC ..... B25C 1/008; B25C 7/00
USPC ..... 123/46 SC
See application file for complete search history.

(56) References Cited

U.S. PATENT DOCUMENTS

| | | | | |
|---|---|---|---|---|
| 3,081,742 A * | 3/1963 | Goldring | B25C 1/04 | 91/454 |
| 4,403,722 A | 9/1983 | Nikolich | | |
| 4,483,783 A * | 11/1984 | Albanese | C11D 3/43 | 106/311 |
| 4,742,112 A * | 5/1988 | Brauer | C08G 18/6576 | 252/182.18 |
| 5,523,008 A * | 6/1996 | Boden | C08F 255/04 | 508/221 |
| 6,834,731 B2 * | 12/2004 | Burlingame | B25C 5/1693 | 173/138 |
| 7,413,104 B2 | 8/2008 | Schiestl | | |

(Continued)

FOREIGN PATENT DOCUMENTS

| | | |
|---|---|---|
| DE | 103 18 856 | 7/2004 |
| EP | 1 666 571 | 6/2006 |

OTHER PUBLICATIONS

DSI Ventures Inc., Beta Fluid, Mar. 19, 2016, https://dsiventures.com/dielectric-fluid/beta-fluid/ (Year: 2016).*

(Continued)

*Primary Examiner* — Eyamindae C Jallow
(74) *Attorney, Agent, or Firm* — Neal, Gerber & Eisenberg LLP

(57) ABSTRACT

Various embodiments of the present disclosure provide powered fastener driving tools and clean lubricants for powered fastener driving tools that reduce contaminant, residue, and deposit buildup or accumulation in the powered fastener driving tools, and thus reduce necessary maintenance for such powered fastener driving tools (or increases the time intervals between such necessary maintenance of powered fastener driving tools).

20 Claims, 3 Drawing Sheets

(56) References Cited

U.S. PATENT DOCUMENTS

| | | | | |
|---|---|---|---|---|
| 7,431,185 | B2 | 10/2008 | Moeller et al. | |
| 7,503,473 | B2 * | 3/2009 | Niblett | B25C 1/008 227/10 |
| 7,673,779 | B2 * | 3/2010 | Moeller | B25C 1/08 123/46 SC |
| 8,025,182 | B2 * | 9/2011 | Murayama | B65D 83/62 222/105 |
| 8,205,777 | B2 * | 6/2012 | Nishikawa | B25C 1/08 227/10 |
| 8,336,749 | B2 * | 12/2012 | Largo | B25C 1/08 227/10 |
| 8,479,631 | B2 | 7/2013 | Ehmig et al. | |
| 8,485,408 | B2 * | 7/2013 | Tanaka | B25C 1/08 123/46 SC |
| 8,689,940 | B2 | 4/2014 | Jagdale et al. | |
| 8,720,764 | B2 * | 5/2014 | Ploss | B25C 1/08 227/10 |
| 9,217,341 | B2 | 12/2015 | Hiner et al. | |
| 9,902,054 | B2 | 2/2018 | Croll | |
| 9,909,714 | B2 | 3/2018 | Kim | |
| 2005/0189393 | A1 * | 9/2005 | Schnell | B25C 1/008 227/130 |
| 2005/0279802 | A1 | 12/2005 | Moeller | |
| 2007/0137934 | A1 | 6/2007 | Nappier et al. | |
| 2008/0009428 | A1 * | 1/2008 | Svarcas | C10M 163/00 508/513 |
| 2017/0326715 | A1 | 11/2017 | Chen et al. | |
| 2018/0036871 | A1 * | 2/2018 | Cordeiro | B25C 1/08 |

OTHER PUBLICATIONS

Calumet, Drakeol 9, Feb. 23, 2015 (Year: 2015).*
Calumet, Drakeol 10, Apr. 22, 2015 (Year: 2015).*
International Search Report and Written Opinion from International Application No. PCT/US2018/063004, dated Jul. 24, 2019 (19 pages).
Beta Fluid®, Fire Resistant Insulating Oil brochure from Dielectric Systems Inc., available 1992 (1 page).

* cited by examiner

POWERED FASTENER DRIVING TOOLS AND CLEAN LUBRICANTS THEREFOR

PRIORITY

This application claims priority to and the benefit of U.S. Provisional Patent Application Ser. No. 62/594,877, filed Dec. 5, 2017, the entire contents of which are incorporated herein by reference.

BACKGROUND

Powered fastener driving tools are well known and commercially widely used throughout North America and other parts of the world. Powered fastener driving tools are typically electrically powered, pneumatically powered, combustion powered, or powder-actuated. Powered fastener driving tools are typically used to drive fasteners (such as nails, staples, and the like) to connect a first object, material, item, or other workpiece to a second object, material, item, or other workpiece.

Various known powered fastener driving tools include: (a) a housing; (b) a power source or supply assembly in, connected to, or supported by the housing; (c) a fastener supply assembly in, connected to, or supported by the housing; (d) a fastener driving assembly in, connected to, or supported by the housing; (e) a trigger mechanism partially in, connected to, or supported by the housing; and (f) a workpiece contact element (referred to herein as a "WCE") connected to or supported by the housing. The WCE is configured to contact a workpiece and to operatively work with the trigger mechanism, such that the WCE needs to be depressed or moved inwardly a predetermined distance with respect to the housing, before activation of the trigger mechanism causes actuation of the power fastener driving tool.

Powered fastener driving tools typically have two different types of operational modes and one or more mechanisms that enable the operator to optionally select one of the two different types of operational modes that the operator desires to use for driving the fasteners. One operational mode is known in the industry as the sequential or single actuation operational mode. In this operational mode, the depression or actuation of the trigger mechanism will not (by itself) initiate the actuation of the powered fastener driving tool and the driving of a fastener into the workpiece unless the WCE element is sufficiently depressed against the workpiece. In other words, to operate the powered fastener driving tool in accordance with the sequential or single actuation operational mode, the WCE element must first be depressed against the workpiece followed by the depression or actuation of the trigger mechanism. Another operational mode is known in the industry as the contact actuation operational mode. In this operational mode, the operator can maintain the trigger mechanism at or in its depressed position, and subsequently, each time the WCE is in contact with, and sufficiently pressed against the workpiece, the power fastener driving tool will actuate, thereby driving a fastener into the workpiece.

One issue with various known powered fastener driving tools such as various known pneumatic powered driving tools and various known combustion powered driving tools is that they need to be taken out of service for maintenance and specifically for cleaning on a regular basis due to contaminant, residue, and/or deposit (such as dust, dirt, and/or soot) build-up inside of these powered fastener driving tools.

More specifically, various known combustion powered fastener driving tools are powered by hydrocarbon fuel from removable fuel cells. These removable fuel cells typically contain a suitable hydrocarbon fuel, and an oil (such as UCON 650 oil) mixed into the hydrocarbon fuel for lubrication of the tool. This known UCON 650 oil has the following properties:

UCON 650 Oil Properties

| Property | LB-650-X |
|---|---|
| Viscosity@ 100° F., SUS ASTM D 445 | 650 |
| Viscosity Index, ASTM D 2270 | 193 |
| Lbs/gallon @ 20° C. | 8.32 |
| Specific Gravity @ 20/20° C. | 0.999 |
| Closed Cup Flash Point ASTM D 93, ° C. (° F.) | 233 (453) |
| Open Cup Flash Point ASTM D 92, ° C. (° F.) | 279 (535) |
| Water, wt % | 0.25 |

This known oil is employed for purposes of reducing metal to metal friction, preventing metal wear, and reducing contaminants, residue, and/or deposits in the combustion fastener driving tools. This known oil has a relatively high flash point and tends to stay in the combustion powered fastener driving tool. The known oil can be cross-linked at high pressure and high temperature such as under normal combustion tool operating conditions or long term operation. The cross-linked oil often gels and collects soot directly from fuel combustion and dust from the working environment. For example, combustion soot and byproducts can be trapped by the gelled oil over time, and can affect the spark ignition and reduce the combustion efficiency of such tools. Thus, this known oil tends to cause various contaminants, residue, and deposits to accumulate in such tools (due to accumulated oil). Thus, while this known oil provides very good lubrication for such tools, use of this known oil in such tools results in necessary periodic cleaning of the tools.

Various known pneumatically powered fastener driving tools are typically powered by pressurized air from a separate pressurized air source connected to the tool by a hose. While these known pneumatically powered fastener driving tools typically have no combustion soot, such tools typically still need lubrication to properly function. For example, various known pneumatic fastener driving tools use an oil (such as DWFP4OZOIL) to maintain their overall performance. This known oil on a long term basis tends to gel and become cross-linked. In practice, various contaminants, residue, and deposits accumulate in such pneumatic fastener driving tools due at least in part to this known oil usage.

Accordingly, there is a need to provide powered fastener driving tools and lubricants that address these problems, and specifically that reduce contaminant, residue, and deposit buildup or accumulation in such powered fastener driving tools.

SUMMARY

Various embodiments of the present disclosure provide powered fastener driving tools and clean lubricants that do not gel or solidify over time under fastener driving tool operating conditions and that address the above problems.

Various embodiments of the present disclosure provide a clean lubricant for use in powered fastener driving tools to reduce contaminant, residue, and deposit buildup or accumulation in the powered fastener driving tools, and thus reduce necessary maintenance of such powered fastener driving tools (or increase the time intervals between necessary maintenance of such powered fastener driving tools). Various embodiments of the present disclosure also provide a clean lubricant for mixing with a fuel and for use in the direct combustion with mixed fuel.

Various embodiments of the present disclosure also provide pneumatic powered fastener driving tools and/or related components configured to employ such clean lubricants in a gas or gaseous phase or state to reduce contaminant, residue, and deposit buildup and accumulation in such powered fastener driving tools.

More specifically, various example embodiments of the present disclosure provide a pneumatic powered fastener driving tool that includes, among other components, a housing and a clean lubricant supply container positioned in the housing and configured to continuously provide the clean lubricant contained in the clean lubricant supply container to a high pressure air stream that flows into the tool and that powers the tool. In various such embodiments, the clean lubricant supply container is positioned in the handle of the housing. In various such embodiments, a clean lubricant transfer or communication mechanism such as a clean lubricant transfer or communication siphon fiber or thread is employed to cause a transfer of the clean lubricant into a liquid state in the clean lubricant supply container to a gaseous state in the pressurized air stream.

Various other example embodiments of the present disclosure provide a pneumatic powered fastener driving tool having a housing, and a clean lubricant supply container connectable to the housing and configured to continuously provide clean lubricant contained in the clean lubricant supply container to high pressure air stream that flows into the tool and that powers the tool. In various such embodiments, the clean lubricant supply container is connectable to an air inlet or port in the handle of the housing and also connectable to an outlet connector of a pneumatic air supply hose or line. In various such embodiments, a clean lubricant transfer or communication mechanism such as a clean lubricant transfer or communication siphon fiber or thread is employed to cause a transfer of the clean lubricant into a liquid state in the clean lubricant supply container to a gaseous state in the pressurized air stream.

Various other example embodiments of the present disclosure provide a pneumatic powered fastener driving tool having a housing, and a clean lubricant supply container otherwise connected or connectable to a pneumatic air supply hose or line that is connectable to the inlet or port of the handle of the housing, and configured to continuously provide clean lubricant contained in the clean lubricant supply container to high pressure air stream that flows through the air supply hose or line into the tool to power the tool. In various such embodiments, a clean lubricant transfer or communication mechanism such as a clean lubricant transfer or communication siphon fiber or thread is employed to cause a transfer of the clean lubricant into a liquid state in the clean lubricant supply container to a gaseous state in the pressurized air stream.

Various other embodiments of the present disclosure also provide combustion powered fastener driving tools and/or related components configured to employ such clean lubricants in a liquid phase or state to reduce contaminant, residue, and deposit buildup and accumulation in such powered fastener driving tools.

More specifically, various example embodiments of the present disclosure provide a combustion powered fastener driving tool including a housing, and a removable combined or premixed fuel and clean lubricant supply cell or container positioned in the housing and configured to provide the premixed clean lubricant and fuel contained in the fuel and clean lubricant supply cell or container to a combustion chamber in the tool.

Various other example embodiments of the present disclosure provide a combustion powered fastener driving tool that includes, among other components, a housing and a clean lubricant supply container positioned in the housing and configured to intermittently or continuously provide clean lubricant contained in the clean lubricant supply container to be mixed with fuel from a fuel cell that enters a combustion chamber in tool.

Various other example embodiments of the present disclosure provide a combustion powered fastener driving tool that includes, among other components, a housing and a clean lubricant supply container connectable to the housing and configured to intermittently or continuously provide clean lubricant contained in the clean lubricant supply container to be mixed with fuel from a fuel cell that enters a combustion chamber in tool.

Other objects, features, and advantages of the present disclosure will be apparent from the following detailed disclosure, taken in conjunction with the accompanying sheets of drawings, wherein like reference numerals refer to like parts.

DETAILED DESCRIPTION

Figure 1:
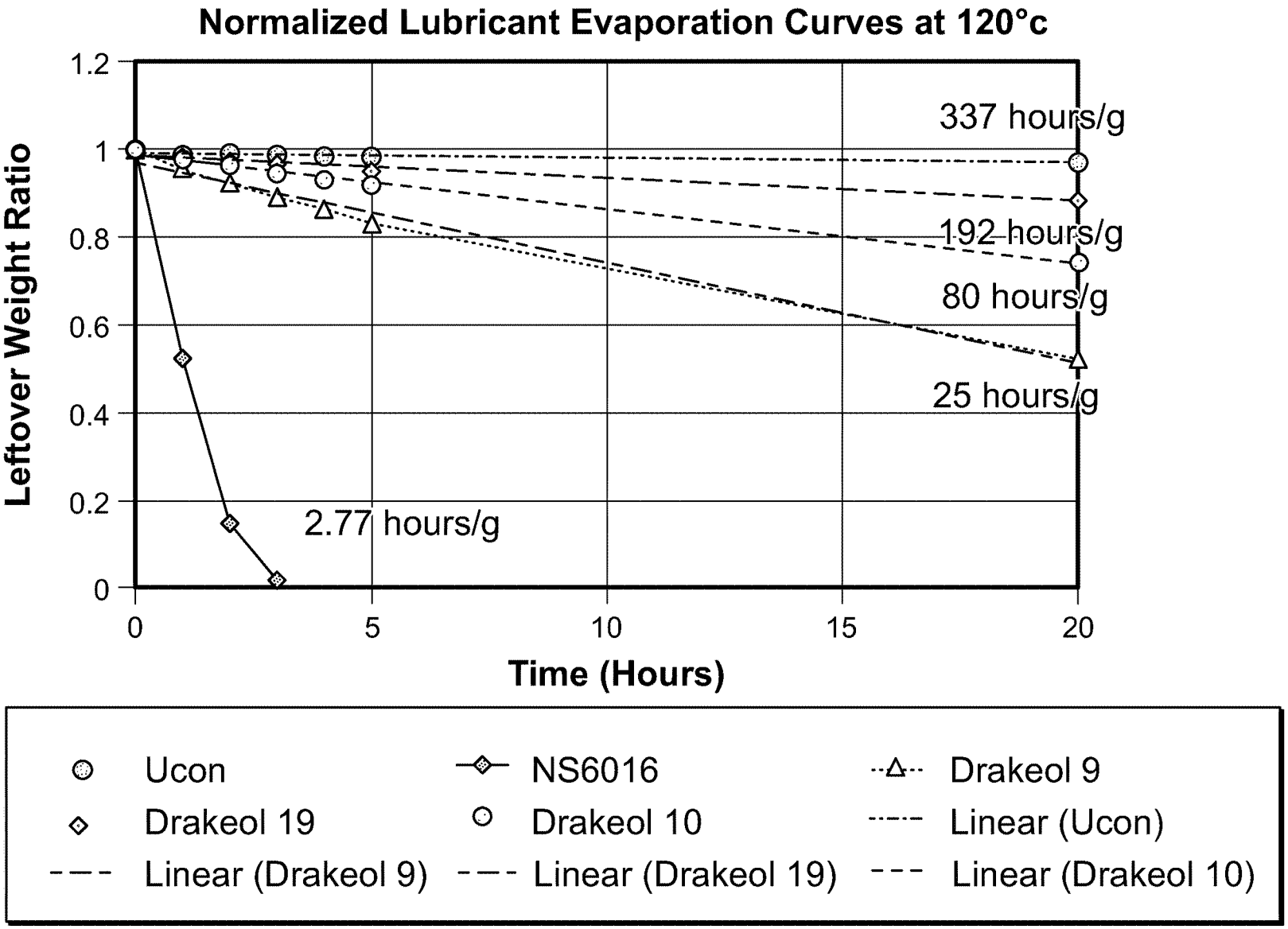
FIG. 1 is a graph showing Normalized Lubricant Evaporation Curves at 120° C.

Various embodiments of the present disclosure provide powered fastener driving tools and clean lubricants that reduce contaminant, residue, and deposit build-up and/or accumulation in the powered fastener driving tools and thus reduce needed maintenance of the powered fastener driving tools.

Clean Lubricant for Powered Fastener Driving Tools

Various embodiments of the present disclosure provide a clean lubricant for powered fastener driving tools that reduces contaminant, residue, and deposit buildup and/or accumulation in such powered fastener driving tools. These clean lubricants of the present disclosure thus reduce necessary maintenance for such powered fastener driving tools (or increase the time between necessary maintenance of such powered fastener driving tools). Various embodiments of the present disclosure also provide a clean lubricant for mixing with a fuel and for use in the direct combustion with mixed fuel.

In various embodiments of the present disclosure, the clean lubricant is a mineral based lubricant.

In various embodiments of the present disclosure, the clean lubricant is a mineral oil with specific evaporation rate range and without solidification under long time high pressure and temperature operations.

In various embodiments, the clean lubricant is a liquid mineral oil that will not gel, will not cross-link, and will not solidify under normal tool operating conditions of a powered fastener driving tool in which it is employed.

In various embodiments of the present disclosure, the clean lubricant is in a liquid form that tolerates dusts from working field without chemical reactions. In these embodiments, the dusts, such as steel flash particulates, are not catalysts for the clean lubricant and do not cause cross-linking.

In various embodiments of the present disclosure, the clean lubricant is or is based on an environmental friendly liquid mineral oil.

In various embodiments of the present disclosure, the clean lubricant is relatively thermally stable in a combustion chamber such as a combustion chamber of a powered fastener driving tool. More specifically, various mineral oils of the present disclosure show certain combustion but generally do not accumulate in a combustion chamber.

In various embodiments of the present disclosure, the clean lubricant is a mineral oil that does not gel and has a viscosity that satisfies the desired lubrication characteristics and release characteristics from the substrate surfaces. This enables dust and soot residue to be blown away from the combustion chamber by the gas pressure that occurs in from the combustion cycles in combustion powered tools (such as cordless combustion powered tools) or that occurs from the compressed air flow in pneumatic powered tools.

In various embodiments, the clean oil lubricant is a light mineral based oil with a viscosity lower than 200 Saybolt universal second (SUS) at 100° F. using the American Society for Testing and Material (ASTM)D 445 method.

In various embodiments of the present disclosure, the clean lubricant is a light mineral based oil identified by the code NS 6016 and available from Syn-Tech Ltd., Addison, Ill. This clean lubricant has not been previously employed in powered fastener driving tools. This clean lubricant has viscosity 7.7 CST@40° C. and flash point at 130° C. More specifically, NS 6016 has the properties set forth in the following Table:

| NS 6016 Properties | |
|---|---|
| Viscosity@40° F., CST ASTM D 445 | 7.7 |
| Viscosity Index, ASTM D 2270 | N/A |
| Lbs/gallon @ 20° C. | |
| Specific Gravity @ 20/20° C. | 0.82 |
| Open Cup Flash Point ASTM D 92, ° C. (° F.) | 130 (266) |
| Water, wt % | N/A |

In other example embodiments of the present disclosure, the clean lubricant is a light mineral based oil identified by the code Drakeol® 9 available from Penreco, Karns City, Pa. This clean lubricant has not been previously employed in powered fastener driving tools. Drakeol® 9 has the properties set forth in the following Table:

| Drakeol ® 9 Properties | |
|---|---|
| Viscosity@100° F., SUS ASTM D 445 | 80/90 |
| Viscosity Index, ASTM D 2270 | 14.2/17 |
| Lbs/gallon @ 20° C. | |
| Specific Gravity @ 20/20° C. | 0.8537 |
| Open Cup Flash Point ASTM D 92, ° C. (° F.) | 199 (390) |
| Water, wt % | N/A |

In other example embodiments of the present disclosure, the clean lubricant is a light mineral based oil identified by the code Drakeol® 10 available from Prenco. Drakeol® 10 has slightly higher viscosity and flashing point than Drakeol® 9. Drakeol® 10 has the properties set forth in the following Table:

| Drakeol ® 10 Properties | |
|---|---|
| Viscosity@100° F., SUS ASTM D 445 | 102/115 |
| Viscosity Index, ASTM D 2270 | 19.0/21.9 |
| Lbs/gallon @ 20° C. | |
| Specific Gravity @ 20/20° C. | 0.848 |
| Open Cup Flash Point ASTM D 92, ° C. (° F.) | 203 (397) |
| Water, wt % | N/A |

In other example embodiments of the present disclosure, the clean lubricant is a light mineral based oil identified by the code Drakeol® 34 available from Prenco. Drakeol® 34 has slightly higher viscosity and flashing point than Drakeol® 9 and Drakeol® 10. Drakeol® 34 has the properties set forth in the following Table:

| Drakeol ® 34 Properties | |
|---|---|
| Viscosity@100° F., SUS ASTM D 445 | 370/410 |
| Viscosity Index, ASTM D 2270 | 72.0/79.5 |
| Lbs/gallon @ 20° C. | |
| Specific Gravity @ 20/20° C. | 0.858 |
| Open Cup Flash Point ASTM D 92, ° C. (° F.) | 246 (475) |
| Water, wt % | N/A |

In other example embodiments of the present disclosure, the clean lubricant is a light mineral based oil identified by the code BETA FLUID® available from Dielectric Systems Inc. BETA FLUID® has higher flash point and lower viscosity than Ucon. The high flash point reduces the lubricant burning and lower viscosity reduces the lubricant accumulation. Another feature is that this mineral oil does not cross-linking under combustion conditions. BETA FLUID® has the properties set forth in the following Table:

| BETA FLUID ® Properties | |
|---|---|
| Viscosity@100° F., SUS ASTM D 445 | 108 |
| Viscosity Index, ASTM D 2270 | |
| Lbs/gallon @ 20° C. | |
| Specific Gravity @ 20/20° C. | 0.87 |
| Open Cup Flash Point ASTM D 92, ° C. (° F.) | 308 (596) |
| Water, wt % | N/A |

These example clean lubricants each balance lubricant retention time at the interface between the various tool components (such as metal pieces, o-rings, and plastic junctions) in the gas and liquid phases or states versus lubricant evaporation rate (the hours to evaporate one gram of oil). In other words, these example clean lubricants each do not evaporate too quickly before they are used or while they are being used, but do relatively quickly evaporate after they have been used.

FIG. 1 shows the relative evaporation rates at 120° C. of these example clean lubricants of the present disclosure. More specifically, FIG. 1 shows, for comparison purposes that the known UCON oil (mentioned above) does not evaporate at all while NS 6016 clean mineral oil evaporates relatively fast for 2.77 hours/gram at 120° C. FIG. 1 also shows that the respective Drakeol® 9 and Drakeol® 10 example clean lubricants of the present disclosure have evaporation rates that are between the evaporation rates of NS 6016 clean mineral oil and the known UCON oil.

In one example, a PASLODE XP® framing tool was tested continuously (including 320 fastener drive cycles) in the lab without cooling. This testing showed that the lubrication and evaporation balance that the Paslode XP tool needed was an evaporation rate of between 25 hours/gram to 80 hours/gram. The 320 continuous shots increased the tool temperature of the exhaust and sleeves to about 100 to 130° C. This means that if the evaporation rate is low, there is not enough time for the oil to function to provide the necessary lubrication.

It should be appreciated that the present disclosure contemplates that the clean mineral oil content or ratio in a fuel cell can be changed in accordance with different viscosities. For example, if the viscosity is low, and the NS 6016 clean lubricant evaporation rate is high, and the clean mineral oil content in the fuel needs to be increased to maintain the lubrication function.

More specifically, in various embodiments, NS 6016 mineral oil is added to the fuel at 2% level while the Drakeol® 9 and 10 is at added at a 1% level.

It should further be appreciated that these example clean lubricants of the present disclosure have a reliable gas phase or gaseous state suitable to provide lubrication to lubricate components of a powered fastener driving tool under various different thermal conditions. This enables the clean mineral oil to lubricate where it is needed to reduce extra oil for trapping dusts.

These example clean lubricants can maintain functionality in the gas phase or gaseous state at suitable temperature ranges including −9 to 300° C. (melting temperature to auto-ignition temperature).

These example clean lubricants suitably avoid thermal degradation and oxidation in the gas phase or gaseous state to maintain functionality although part of the clean lubricant may be combusted.

These example clean lubricants of the present disclosure have a reliable liquid state suitable to provide a relatively thin layer of lubrication to lubricate components of a powered fastener driving tool (such as a slidable piston in a cylinder of the tool) under various different thermal conditions.

These example clean lubricants maintain functionality in the liquid state at suitable temperature ranges including −9° C. to 300° C.

These example clean lubricants suitably avoid thermal degradation and oxidation in the liquid state to maintain functionality.

These example clean lubricants balance lubricant retention time in the liquid state versus lubricant evaporation rate.

These example clean lubricants are considered to be safe for contact by humans.

These example clean lubricants minimize contamination of the environment.

It should thus be appreciated that these example clean lubricants: (a) have a relatively low viscosity and is thus flowable at low temperatures; and (b) also have a relatively high flash point and a relatively low boiling point and thus provide protection at relatively high temperatures.

It should also be appreciated that these example clean lubricants do not thermally degrade or "cook" onto hot tool component surfaces, and does not tend to oxidize at the elevated temperatures (such as 300° C.).

It should also be appreciated that these example clean lubricants leave less residue in the tool and thus reduces deposits.

It should also be appreciated that clean lubricants of the present disclosure also function to clean the powered fastener driving tool in situ when the fuel cell contains the clean mineral oil lubricant (as further describe below). Various experiments have shown that the example mineral oil under pressure and hot temperature can blow away deposits and clean the tool internally.

It should also be appreciated that while the pneumatic fastener driving tools do not have combustion cycles, the friction between piston and the sleeve of the tool typically generates certain amounts of heat that will subject the clean lubricant of the present disclosure to evaporation. For example, the NS 6016 clean mineral oil of the present disclosure will evaporate between 25 to 80 hours/grams and is thus suitable for pneumatic tool lubrication in situ.

1st Example—Pneumatic Powered Fastener Driving Tool

Figure 2:
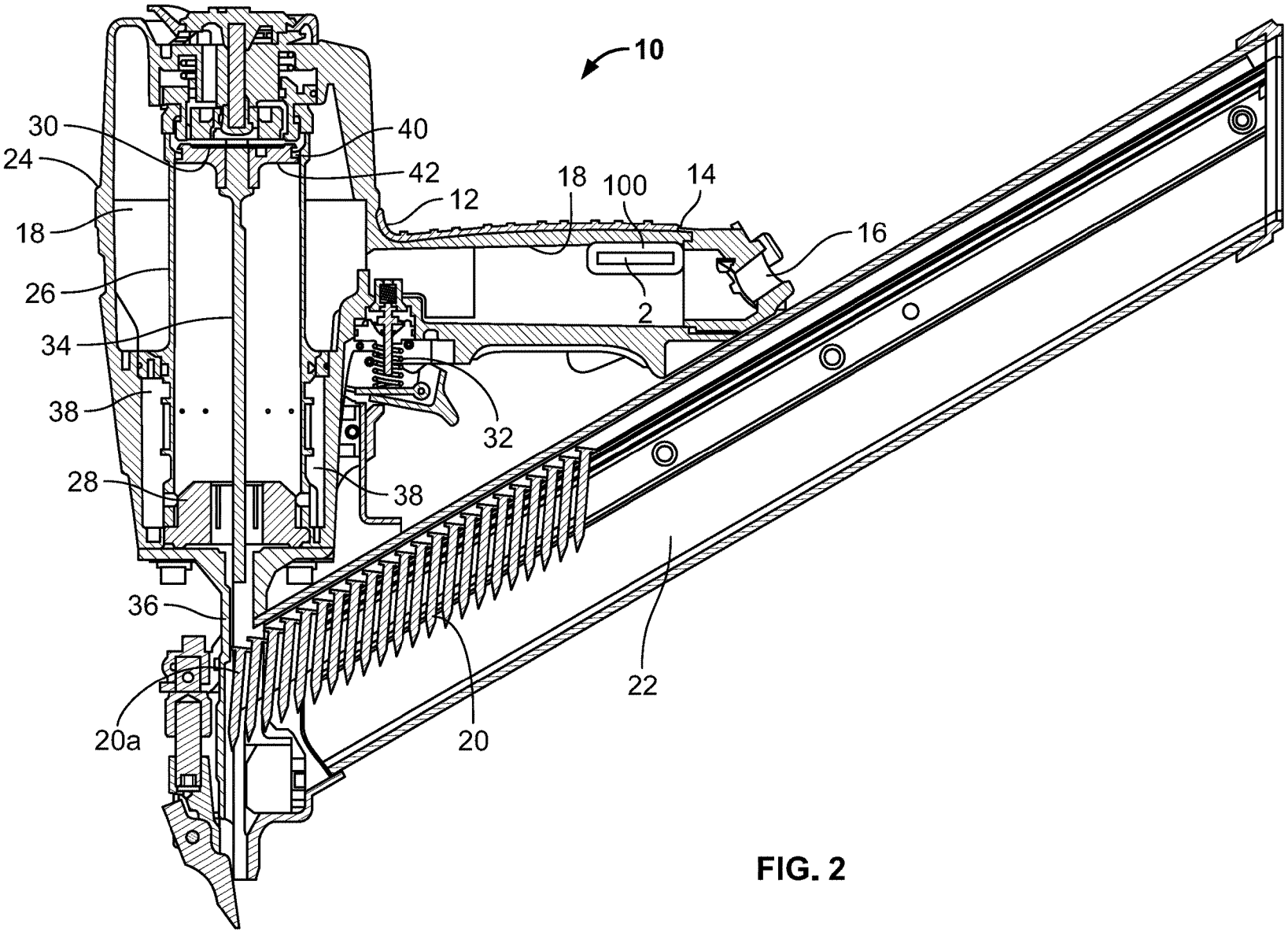
FIG. 2 is a side diagrammatic perspective view of a powered fastener driving tool of one example embodiment of the present disclosure.

Referring now to FIG. 2, a pneumatic powered fastener driving tool of one example embodiment of the present disclosure is generally illustrated and indicated by numeral 10. Pneumatic powered fastener driving tools are generally well-known in the industry, and thus not described in detail in the present disclosure. The tool 10 generally includes a housing 12 having a handle or handle portion 14 including or defining an air port or air inlet 16 through which pressurized air is supplied via a suitable connection to a hose (not shown) and an air compressor (not shown). The housing 12 defines one or more interior chambers such as an interior chamber 18 that function as pressurized air reservoirs. The tool 10 has and/or is configured to support a suitable fastener magazine 22 (which may or may not be removable from the tool). The fastener magazine 22 is configured to hold multiple fasteners 20 loadable into the magazine 22.

The example tool 10 further includes a suitable power unit 24 in the housing 12. In this example, the power unit 24 includes a cylinder 26 surrounded by the air chamber 18. The power unit 24 of the tool 10 includes a bumper 28 at a lower end of the cylinder 26 and a piston 30 configured to slidingly reciprocate within the cylinder 26. FIG. 2 shows the piston 30 in a pre-firing position. During a fastener-driving or power stroke, a trigger valve 32 controllable by a user causes a release of a dose of pressurized air from within the chamber 18 and sufficient for driving the piston 30 downwardly in the cylinder 26 towards the bumper 28. The power unit 24 of the tool 10 includes a driver blade 34 depending from the piston 30 that is configured to engage a forward most fastener (such as fastener 20*a*) urged into a nose or shear block 36, and to ultimately drive the fastener into a workpiece. After the driving cycle, the piston 30 is returned to the pre-firing position by a blast of pressurized air delivered by or from a return chamber 38 in the housing 12. The return chamber 38 is separate from the main chamber 18 and receives its supply of pressurized air from the cylinder 26 during the driving cycle.

In this illustrated example embodiment, the tool 10 further includes a clean lubricant supply mechanism in the housing 12. The clean lubricant supply mechanism includes a clean lubricant supply container 100 suitably positioned in and secured in the housing 12. In this illustrated example embodiment, the clean lubricant supply container 100 is securely positioned in the handle of the housing 12; however, it should be appreciated that it can be positioned in other locations in the housing in accordance with the present disclosure. The clean lubricant supply container 100 is configured to continuously provide the clean lubricant contained in the clean lubricant supply container 100 to a high pressure air stream that flows into the housing 12 of the tool 10 through the inlet or port 16 in the handle 14 to power the tool 10.

In this illustrated example embodiment, the clean lubricant supply container 100 is a metal based container. The clean lubricant supply container can be any suitable container in accordance with the present disclosure. The clean lubricant supply container includes at least one opening or outlet port (through which a clean lubricant transfer or communication siphon material extends (as described below) and at least one closable opening or inlet port for facilitating filling the clean lubricant supply container in the housing. The container may include other closeable or opening ports. Likewise, in this example, the housing can include one or more closeable openings or ports to provide access to the container for filling purposes.

In this example embodiment, the clean lubricant supply mechanism includes a replaceable clean lubricant transfer or communication siphon material (not shown) of a suitable length that is configured to cause a transfer of the clean lubricant stored in a liquid form in the clean lubricant supply container 100 to a gaseous state in the pressurized air stream. In other words, the replaceable clean lubricant transfer or communication siphon material forms or makes a connection between the clean lubricant oil stored in a liquid phase in the clean lubricant supply container to a gas phase or gaseous state in the air stream. In various example embodiments, the replaceable clean lubricant supply transfer material includes a suitable replaceable fiber or thread such as a suitable a cotton fiber or cellulose fiber.

In various example embodiments, one end of the clean lubricant transfer or communication siphon material is positioned in the liquid clean lubricant oil in the clean lubricant supply container and the other end of the clean lubricant transfer or communication siphon material is positioned in a high pressure air communication line 2 in the handle 14 of the housing of the tool 10. The high pressure air stream causes the evaporation of the clean lubricant in the clean lubricant transfer or communication siphon material into the high pressure air stream. The high pressure air steam carries the clean lubrication gas vapor in the air stream to the various parts of the tool for lubrication purpose. This provides continuous lubrication during operation of the tool 10. This combination of the clean lubricant and the delivery of the clean lubricant into the pressurized air stream reduces or eliminates accumulation of contaminants, residue, and deposits in the tool 10, makes the tool operation much smoother, and increases the time between necessary maintenance intervals.

It is expected that in this illustrated example embodiment, approximately 10 milli-liters of the example clean lubricant NS 6016 would last approximately 200 continuous working days and thus would not have to be replaced or refilled often.

2nd Example—Pneumatic Powered Fastener Driving Tool

Figure 3:
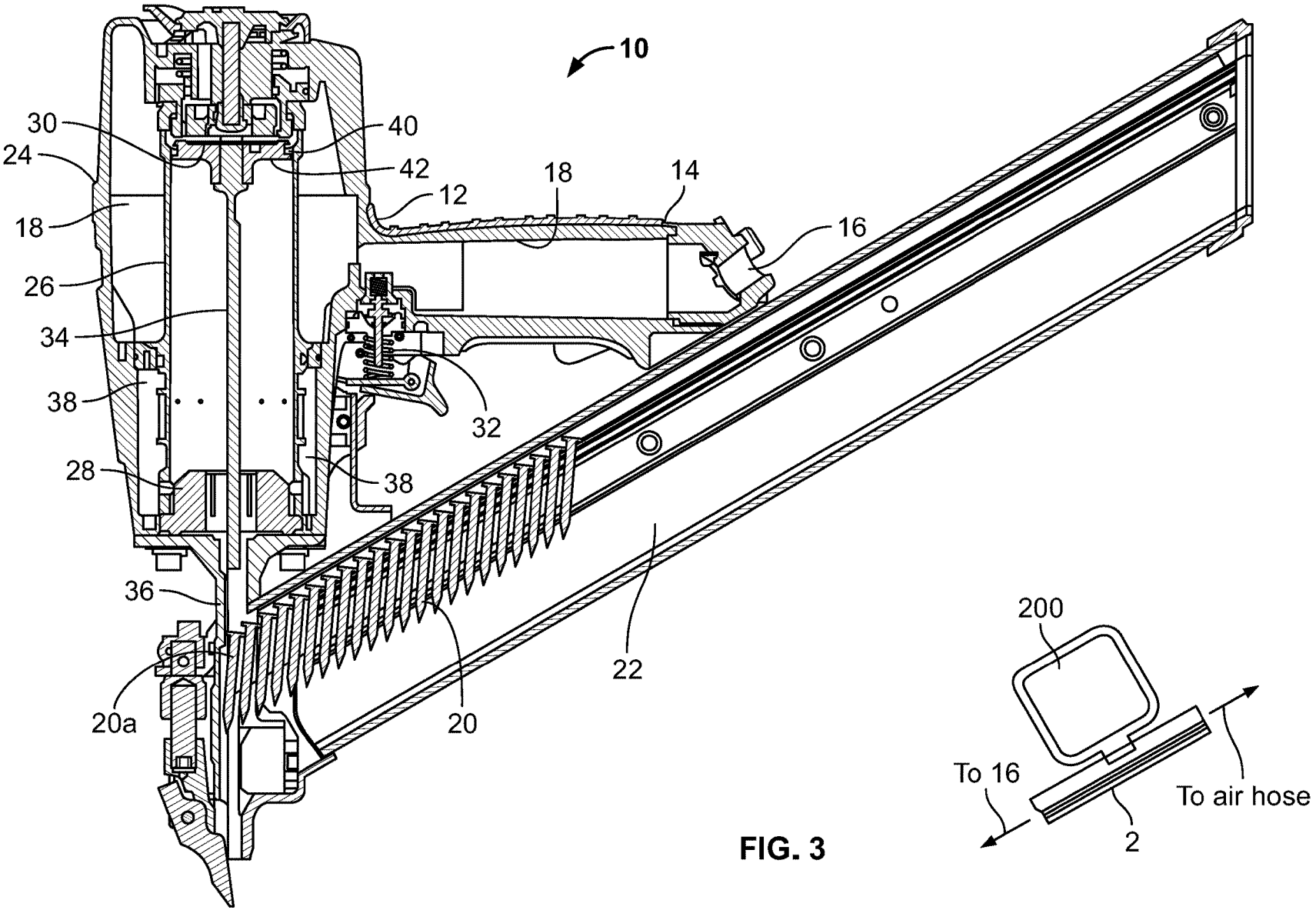
FIG. 3 is a side diagrammatic perspective view of a powered fastener driving tool of another example embodiment of the present disclosure.

Referring now to FIG. 3, a pneumatic powered fastener driving tool of another example embodiment of the present disclosure is generally illustrated and also indicated by numeral 10. This example embodiment is the same as the example embodiment of FIG. 1 except that in this illustrated example embodiment, the clean lubricant supply mechanism is not inside the housing 12 but rather is removably connectable to the housing 12. More specifically, this clean lubricant supply mechanism includes a clean lubricant supply container 200 attached to an air communication line or director that is removably connectable to the housing 12, and specifically the handle 14 of the housing in this example embodiment.

In this illustrated example embodiment, the clean lubricant supply container 200 is a metal based container. This clean lubricant supply container can be any suitable container in accordance with the present disclosure. This clean lubricant supply container includes at least one opening or outlet port (through which a clean lubricant transfer or communication siphon material extends (as described below) and at least one closable opening or inlet port for facilitating filling the clean lubricant supply container in the housing. The container may include other closeable or opening ports.

In this illustrated example embodiment, the clean lubricant supply mechanism includes a replaceable clean lubricant transfer or communication siphon material (not shown) of a suitable length that is configured to cause a transfer of the clean lubricant stored in a liquid form in the clean lubricant supply container 200 to a gaseous state in the pressurized air stream. In other words, the replaceable clean lubricant transfer or communication siphon material forms or makes a connection between the clean lubricant oil stored in a liquid phase in the clean lubricant supply container to a gas phase or gaseous state in the air stream. In various example embodiments, the replaceable clean lubricant supply transfer material includes a suitable replaceable fiber or thread such as a suitable a cotton fiber or cellulose fiber.

In various example embodiments, one end of the clean lubricant transfer or communication siphon material is positioned in the liquid clean lubricant oil in the clean lubricant supply container and the other end of the clean lubricant transfer or communication siphon material is positioned in an air communication line or director 2 that is removably connectable to the housing 12, and specifically the handle 14 of the housing in this example embodiment. The high pressure air stream causes the evaporation of the clean lubricant in the clean lubricant transfer or communication siphon material into the high pressure air stream. The high pressure air steam carries the clean lubrication gas vapor in the air stream into the housing 12 and to the various parts of the tool for lubrication purpose. This provides continuous lubrication during operation of the tool 10. This combination of the clean lubricant and the delivery of the clean lubricant into the pressurized air stream reduces or eliminates accumulation of contaminants, residue, and deposits in the tool 10, makes the tool operation much smoother, and increases the time between necessary maintenance intervals.

It is expected that in this illustrated example embodiment, approximately 10 milli-liters of the example clean lubricant NS 6016 would last approximately 200 continuous working days and thus would not have to be replaced or refilled often.

3rd Example—Pneumatic Powered Fastener Driving Tool

Various other example embodiments of the present disclosure (which are not shown) provide a pneumatic powered fastener driving tool including a housing, and a clean lubricant supply container otherwise connected or connectable to a either (a) a pneumatic supply source; or (b) to a pneumatic air supply hose or line that is connectable to: (i) a pneumatic supply source at one end; and (ii) to the inlet or port of the handle of the housing at the other end. In such embodiments, the clean lubricant supply container is configured to continuously provide clean lubricant contained in the clean lubricant supply container to high pressure air stream (in the same manner as described above) before the high pressure air flows into the tool to power the tool. In various such embodiments, a clean lubricant transfer or communication siphon mechanism such as a clean lubricant transfer or communication siphon fiber or thread is employed to cause a transfer of the clean lubricant into a liquid state in the clean lubricant supply container to a gaseous state in the pressurized air stream.

4th Example—Combustion Powered Fastener Driving Tool

Various other example embodiments of the present disclosure provide a combustion powered fastener driving tool (not shown) that includes, among other components, a housing and a clean lubricant supply container (not shown) positioned in the housing (not shown) of the tool and configured to continuously provide liquid clean lubricant contained in the clean lubricant supply container to mix with fuel that enters a combustion chamber (not shown) in the tool and that powers the tool. In this example embodiment, the clean lubricant supply container can be a metal based container or any other suitable container. This clean lubricant supply container includes at least one opening or outlet port and at least one closable opening or inlet port for facilitating filling the clean lubricant supply container in the housing. The container may include other closeable or opening ports. Likewise, in this example, the housing can include one or more closeable openings or ports to provide access to the container for filling purposes. Alternatively, this clean lubricant container may be removable positioned in the housing or removably attached to the housing.

Thus, in various such embodiments, the present disclosure provide a powered fastener driving tool comprising: (a) a housing assembly including a main compartment assembly and a handle assembly extending from the main compartment assembly, said housing assembly configured to removably receive a fuel supply container and to receive or support a clean lubricant supply container containing a clean lubricant; (b) a combustion power supply assembly positioned in the housing assembly; (c) a fastener supply assembly configured to receive fasteners and supported by the housing assembly; (d) a fastener driving assembly positioned in the housing assembly; (e) a trigger mechanism assembly supported by the handle assembly; and (f) a workpiece contact element assembly supported by the housing assembly.

In various such embodiments, the clean lubricant is a light mineral based oil identified by the code NS 6016 and employed in a ratio of approximately 2% of the amount of fuel. In other words, the mixture of hydrocarbon fuel and clean lubricant in this example embodiment is approximately 98% fuel and approximately 2% clean lubricant.

In various such embodiments, the clean lubricant is a light mineral based oil identified by the code Drakeol® 9, Drakeol® 10, or BETA FLUID® and employed in a ratio of approximately 1% of the amount of fuel. In other words, the mixture of hydrocarbon fuel and clean lubricant in this example embodiment is approximately 99% fuel and approximately 1% clean lubricant.

5th Example—Combustion Powered Fastener Driving Tool

Various other example embodiments of the present disclosure provide a combustion powered fastener driving tool (not shown) that includes, among other components, a housing (not shown) and a combined fuel supply and clean lubricant supply container (not shown) removably positioned in the housing or removably connected to the housing and configured to provide a mixture of clean lubricant and fuel that is contained in the combined fuel supply and clean lubricant supply container to a combustion chamber (not shown) in the tool and that powers the tool.

In various such example embodiments of the present disclosure, a combined fuel supply and clean lubricant supply container containing a suitable fuel (such a known hydrocarbon fuel) and the clean lubricant of the present disclosure can be employed in a variety of currently known or commercially available combustion fastener driving tools to provide a mixture of clean lubricant and fuel that is contained in the combined fuel supply and clean lubricant supply container to a combustion chamber (not shown) in the tool and to power the tool.

In certain tests, the clean oil fuel cell was used to clean used tools that had been used with the known UCON oil. These tests showed that the clean oil of the present disclosure can dissolve some residue and loosen the interface area between the gummy residue and the tool parts. With the pressure and heat from such tools, the residues from used tool were removed using the clean oil fuel cell of the present disclosure. Thus, it should be appreciated that existing used tools in the market can benefit from the clean oil technology to maintain the tool for longer life.

In various such embodiments, the present disclosure provides a powered fastener driving tool comprising: (a) a housing assembly including a main compartment assembly and a handle assembly extending from the main compartment assembly, said housing assembly configured to removably receive a combined fuel supply and clean lubricant supply container containing a hydrocarbon fuel and a clean lubricant; (b) a combustion power supply assembly positioned in the housing assembly; (c) a fastener supply assembly configured to receive fasteners and supported by the housing assembly; (d) a fastener driving assembly positioned in the housing assembly; (e) a trigger mechanism assembly supported by the handle assembly; and (f) a workpiece contact element assembly supported by the housing assembly.

In various such embodiments, the clean lubricant is a light mineral based oil identified by the code NS 6016 and employed in a ratio of approximately 2% of the amount of fuel. In other words, the mixture of hydrocarbon fuel and clean lubricant in this example embodiment is approximately 98% fuel and approximately 2% clean lubricant.

In various such embodiments, the clean lubricant is a light mineral based oil identified by the code Drakeol® 9, Drakeol® 10, or BETA FLUID® and employed in a ratio of approximately 1% of the amount of fuel. In other words, the mixture of hydrocarbon fuel and clean lubricant in this example embodiment is approximately 99% fuel and approximately 1% clean lubricant.

Tests of Example Clean Lubricant in Combustion Powered Fastener Driving Tool

Tests were performed on a known commercially available combustion powered fastener driving tool with three different fuel cartridges including: (a) a fuel cell containing hydrocarbon fuel mixed with the clean lubricant of the present disclosure and specifically the NS 6016 clean lubricant (at a 1% ratio to the fuel); (b) a fuel cell containing hydrocarbon fuel mixed with the known UCON oil mentioned above (at a 1% ratio to the fuel as is currently commercially provided in commercially available fuel cells); and (c) a fuel cell containing hydrocarbon fuel with no oil (i.e., oil free). All potential variables in performing these tests with these three fuel cells were the same. The results of these tests were are set forth in the following table:

| Fuel cells/ lubricant oil | Shots | Fan Start Weight (g) | Fan End Test Weight (g) | ΔW (mg) | Residue (mg) per 10,000 shots |
|---|---|---|---|---|---|
| Mineral oil (1%) | 44,817 | 5.4239 | 5.4651 | 41.2 | 9.19 |
| UCON oil | 13,496 | 5.4086 | 5.4373 | 28.7 | 21.26 |
| Oil free | 13,601 | 5.4309 | 5.4356 | 4.7 | 3.46 |

In this test, the tool with oil free fuel cells resulted in hundreds of blank fires because the piston of the tool often did not return to the firing position. The reason for this was that there was no lubrication between piston and sleeve of combustion chamber of the tool. The 1% mineral oil of the clean lubricant of the present disclosure showed significantly better performance and reduced the residue weight by more than half when compared to the known UCON oil mentioned above. Surprisingly, the clean oil residue does not increase with more shots while the known UCON oil does. The explanation is the surface tension of the clean oil on the tool part surface keeps some oil for lubrication, which is essential for the tools.

It should be appreciated that the clean lubricant of the present disclosure may be employed in other tools.

It will be understood that modifications and variations may be effected without departing from the scope of the novel concepts of the present invention, and it is understood that this application is to be limited only by the scope of the claims.

The invention is claimed as follows:

1. A combustion powered fastener driving tool comprising:

a housing assembly including a main compartment assembly and a handle assembly extending from the main compartment assembly, said housing assembly configured to removably receive a combined fuel supply and clean lubricant supply container containing a mixture of a hydrocarbon fuel and a clean lubricant, wherein the clean lubricant includes a light mineral based oil that does not gel or solidify with time under the combustion powered fastener driving tool conditions, and wherein the mixture includes a determined amount of the light mineral based oil added to the hydrocarbon fuel based on a viscosity of the light mineral based oil and an evaporation rate of the light mineral based oil;

a combustion power supply assembly positioned in the housing assembly;

a fastener supply assembly configured to receive fasteners and supported by the housing assembly;

a fastener driving assembly positioned in the housing assembly;

a trigger mechanism assembly supported by the handle assembly; and a workpiece contact element assembly supported by the housing assembly.

2. The combustion powered fastener driving tool of claim 1, where the viscosity of the light mineral based oil is lower than 200 Saybolt universal second (SUS) at 100° F. using the American Society for Testing and Material (ASTM) D 445 method.

3. The combustion powered fastener driving tool of claim 1, where the light mineral based oil has an evaporation time lower than 200 hours per gram at 120° C.

4. The combustion powered fastener driving tool of claim 1, wherein the mixture of the hydrocarbon fuel and the clean lubricant is approximately 98% fuel and approximately 2% clean lubricant.

5. The combustion powered fastener driving tool of claim 1, wherein the mixture of the hydrocarbon fuel and the clean lubricant is approximately 99% fuel and approximately 1° clean lubricant.

6. The combustion powered fastener driving tool of claim 1, which further comprises the clean lubricant supply container removably received in the housing assembly.

7. A combustion powered fastener driving tool combined fuel supply and clean lubricant supply container assembly comprising:

a container;

a hydrocarbon fuel in the container; and a clean lubricant in the container, wherein the clean lubricant includes a light mineral based oil that does not gel or solidify with time under the combustion powered fastener driving tool operation conditions, and wherein a determined amount of the light mineral based oil added to the hydrocarbon fuel in the container is based on a viscosity of the light mineral based oil and an evaporation rate of the light mineral based oil.

8. The combustion powered fastener driving tool and clean lubricant supply container assembly of claim 7, where the viscosity of the light mineral based oil is lower than 200 SUS at 100° F. using ASTM D 445.

9. The combustion powered fastener driving tool and clean lubricant supply container assembly of claim 7, where the light mineral based oil has an evaporation time lower than 200 hours per gram at 120° C.

10. The combustion powered fastener driving tool combined fuel supply and clean lubricant supply container assembly of claim 7, wherein a mixture of the hydrocarbon fuel and the clean lubricant is approximately 98% fuel and approximately 2% clean lubricant.

11. The combustion powered fastener driving tool combined fuel supply and clean lubricant supply container assembly of claim 7, wherein a mixture of the hydrocarbon fuel and the clean lubricant is approximately 99% fuel and approximately 1% clean lubricant.

12. A pneumatic powered fastener driving tool comprising:

a housing assembly including a main compartment assembly and a handle assembly extending from the main compartment assembly;

a clean lubricant supply container positioned in the housing assembly, and configured to contain a clean lubricant, wherein the clean lubricant includes a light mineral based oil that does not gel or solidify with time under the pneumatic powered fastener driving tool operation conditions, and wherein the clean lubricant supply container is configured to dispense the clean lubricant into a pressurized air stream that flows through the housing assembly;

a power supply assembly positioned in the housing assembly;

a fastener supply assembly configured to receive fasteners and supported by the housing assembly;

a fastener driving assembly positioned in the housing assembly;

a trigger mechanism assembly supported by the handle assembly; and a workpiece contact element assembly supported by the housing assembly.

13. The pneumatic powered fastener driving tool of claim 12, where the clean lubricant is a light mineral based oil with an evaporation time lower than 200 hours per gram at room temperature.

14. The pneumatic powered fastener driving tool of claim 12, which further comprises a clean lubricant transfer member configured to transfer the clean lubricant from the clean lubricant supply container to the pressurized air stream.

15. The pneumatic powered fastener driving tool of claim 14, wherein the clean lubricant transfer member comprises a removable fiber positioned in the clean lubricant supply container.

16. The pneumatic powered fastener driving tool of claim 14, wherein a first end of the clean lubricant transfer member is positioned in the clean lubricant container in the clean lubricant supply container and a second end of the clean lubricant transfer member extends from a port defined in the clean lubricant supply container and is positioned in the pressurized air stream.

17. A pneumatic powered fastener driving tool clean lubricant supply container assembly comprising:

a container;

a clean lubricant in the container, wherein the clean lubricant includes a light mineral based oil that does not gel or solidify with time under the pneumatic powered fastener driving tool operation conditions; and a connector configured to connect the container to a housing assembly of a pneumatic powered fastener driving tool, wherein the container is configured to dispense the clean lubricant into a pressurized air stream that flows through the housing assembly.

18. The pneumatic powered fastener driving tool clean lubricant supply container assembly of claim 17, where the clean lubricant is a light mineral based oil with an evaporation time lower than 200 hours per gram at room temperature.

19. The pneumatic powered fastener driving tool clean lubricant supply container assembly of claim 17, which further comprises a clean lubricant transfer member configured to transfer the clean lubricant from the container to the pressurized air stream.

20. The pneumatic powered fastener driving tool clean lubricant supply container assembly of claim 19, wherein a first end of the clean lubricant transfer member is positioned in the clean lubricant contained in the container and a second end of the clean lubricant transfer member extends from a port defined in the container and is positioned in the pressurized air stream.

* * * * *